US005339750A

United States Patent [19]

Smies

[11] Patent Number: 5,339,750

[45] Date of Patent: Aug. 23, 1994

[54] ADJUSTABLE WORK TABLE

[75] Inventor: Ronald J. Smies, Oostburg, Wis.

[73] Assignee: Hamilton Industries, Sheboygan, Wis.

[21] Appl. No.: 135,132

[22] Filed: Oct. 12, 1993

Related U.S. Application Data

[63] Continuation of Ser. No. 858,945, Mar. 27, 1992, abandoned.

[51] Int. Cl.[5] ..... A47B 9/00

[52] U.S. Cl. ..... 108/147; 108/8; 248/157

[58] Field of Search ..... 108/1, 7, 8, 147; 248/157, 161

[56] References Cited

U.S. PATENT DOCUMENTS

| | | | |
|---|---|---|---|
| 2,150,397 | 3/1939 | Owen | 108/8 |
| 2,860,938 | 11/1958 | Marti | 108/147 |
| 3,521,341 | 7/1970 | Hornlein | 248/161 |
| 4,381,095 | 4/1983 | Kritske . | |
| 4,440,096 | 4/1984 | Rice et al. | 108/147 X |
| 4,604,955 | 8/1986 | Fleischer et al. | 108/147 |
| 4,604,956 | 8/1986 | Grebel et al. | 108/147 |
| 4,637,322 | 1/1987 | Hampshire et al. | 108/147 X |
| 4,681,042 | 7/1987 | Roberts | 108/8 X |
| 4,805,538 | 2/1989 | Fisher et al. | 108/147 X |
| 4,815,391 | 3/1989 | Lee | 108/7 |
| 5,101,736 | 4/1992 | Bommarito et al. | 108/147 X |

*Primary Examiner*—Michael Milano

*Attorney, Agent, or Firm*—Andrus, Sceales, Starke & Sawall

[57] ABSTRACT

A raisable and lowerable table comprises a base, and at least one movably extensible vertical column attached to the base having a table top carried on the vertical column. Pivot means may be provided for moving the table top into any of a range of pivoted positions, preferably on both sides of the horizontal position of the table top. Motor are provided for holding the table top in any of the range of pivoted positions.

6 Claims, 2 Drawing Sheets

ADJUSTABLE WORK TABLE

This is a continuation of application Ser. No. 07/858,945, filed Mar. 27, 1992 now abandoned.

BACKGROUND OF THE INVENTION

Raisable and lowerable tables are well known to the art, for example, the Trakker adjustable table manufactured by Haworth Inc., and many other examples.

It is also known to provide means to a raisable and lowerable table for tilting the table top toward the user in an adjustable manner.

By this present invention, a table, typically a desk-like work table, is rendered more useful and desirable for computer aided design and other work activities by providing a pair of raisable and lowerable, separate table tops to provide a two level table if desired, in which the rear table top is capable of tilting through any of a range of pivoted positions on both sides of the horizonal position of the table top. Thus, the table top can be tilted toward the user, but, for monitor eye angle to avoid light glare or the like, the same table top can be tilted through the horizontal position to tilt rearwardly from the user to a certain degree, which provides great versatility of use for a large variety of purposes.

DESCRIPTION OF THE INVENTION

By this invention, a raisable and lowerable table is provided, which table comprises a base, plus a movably extensible vertical column attached to the base. A table top is carried on the vertical column.

In accordance with this invention, pivot means are provided for moving the table top into any of a range of pivoted positions on both sides of the horizontal position of the table top. Means are also provided for holding the table top in any of said range of pivoted positions.

Additionally, it is contemplated by this invention that a pair of vertical columns may be attached to the base, each vertical column carrying a separate, pivotally attached table top for independent raising and lowering of each such table top. Thus, the same table may comprise a substantially flat surface, where both table tops are in a horizontal position at the same height. If desired, the rear table top may be raised relative to the forward table top from the position that the user is standing, with either of the table tops being in a position angled from the horizontal, or, if desired, in the horizontal position. Thus, a versatile table is provided which is suitable for a multitude of different uses.

Further by this invention, separate, motor-driven means are provided (1) to extend and retract the vertical column or columns, and (2) to pivotally move and to hold the table top or table tops in any of the range of piloted positions.

Accordingly, the pivoting of the table top or table tops present and their vertical elevations may be selected in a manner that is entirely independent of each other, for the above-described, great flexibility of use of the table of this invention.

DESCRIPTION OF SPECIFIC EMBODIMENTS

Figure 1:
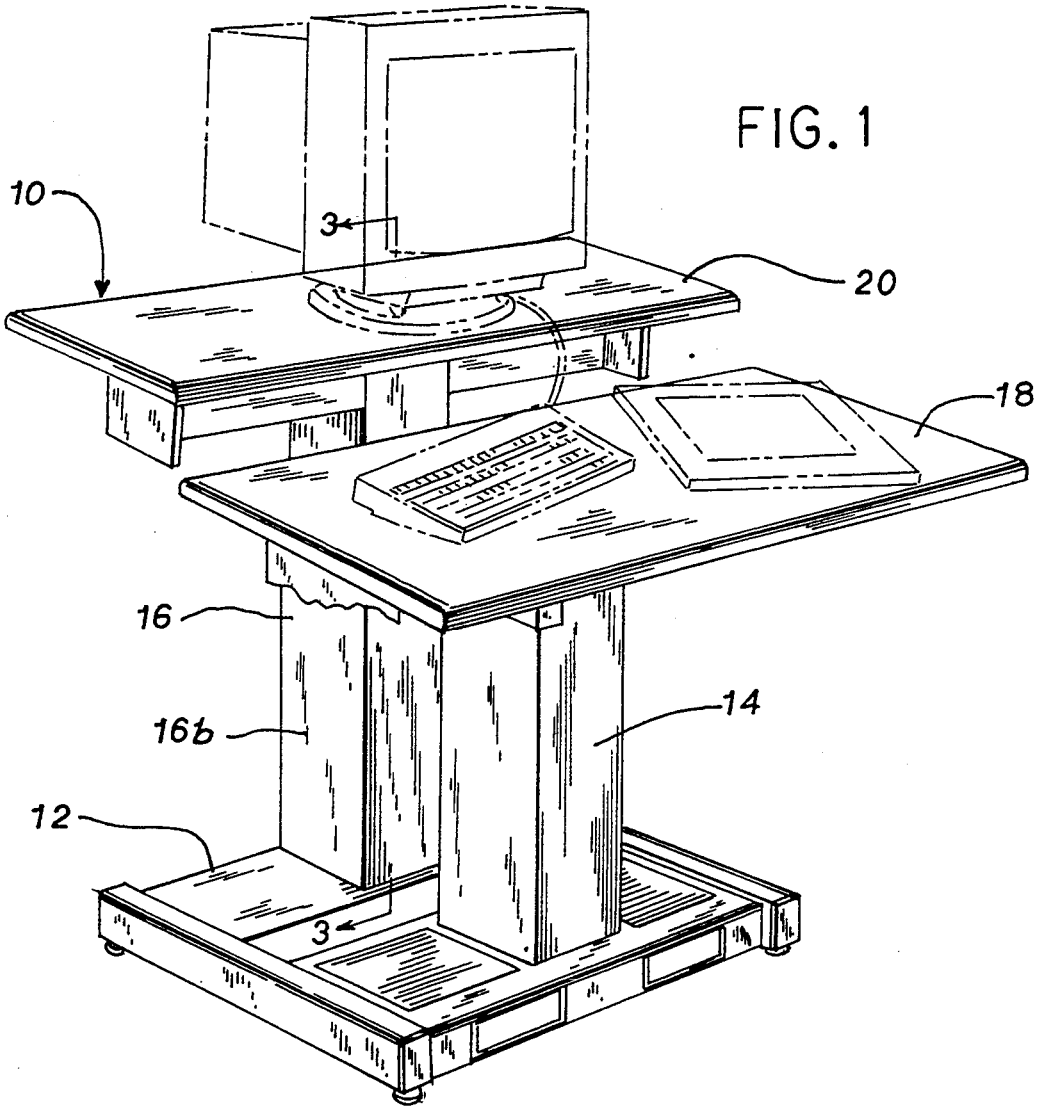
FIG. 1 is a perspective view of a work table in accordance with this invention.

Referring to the drawings, adjustable work table 10 is shown comprising base 12 of conventional design, and a pair of vertical columns 14, 16, each of which respectively carries a table top 18, 20.

Figure 2:
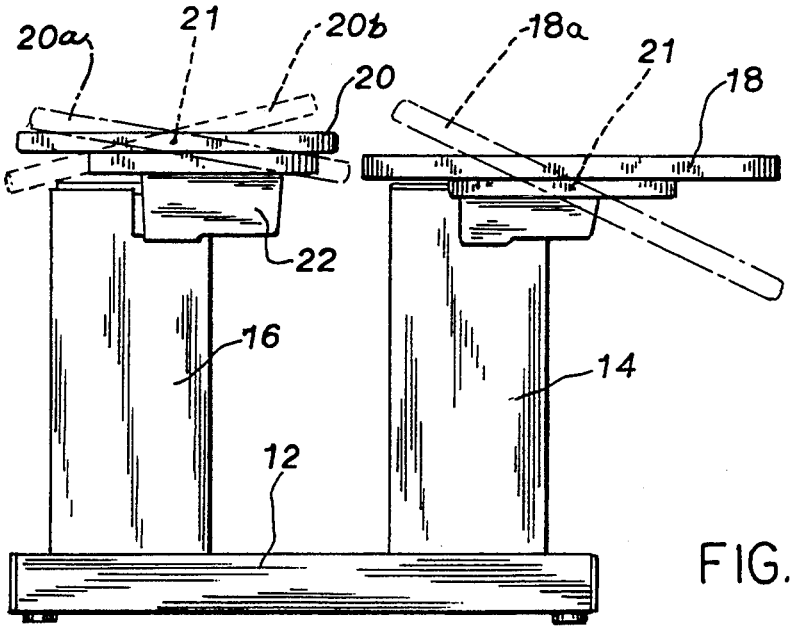
FIG. 2 is an elevational view of the work table of FIG. 1; showing various pivoting positions of the table tops present.

Each column 14, 16 is independently capable of raising the respective table top 18, 20 that it carries to a varying, desired height, as illustrated in FIG. 1, with such varying height being different from the respective heights of table tops 18, 20, shown in the same table in FIG. 2.

Furthermore, pivot means 21 are provided to each table top 18, 20 for moving the respective table tops in an independent manner into any of a range of pivoted positions as illustrated in FIG. 2 by the respective dotted line positions **18*a*, 20*a*** of the respective table tops.

Furthermore, table top 20 is capable of pivoting through the horizontal into a reverse pivoting position **20*b*, which provides a desirable increased utility for the table, to facilitate drawing while the user is standing, for example, in a manner which may facilitate his drawing activity and may avoid glare from overhead lights. But in the particular embodiment shown, table top 18 moves only between the horizontal position of table top 18 and the pivoted position 18*a***.

Referring particularly to FIGS. 3–7, the working details of column 16 are shown. However, the structure and working details of column 14 are substantially identical to that shown herein as well.

Figure 3:
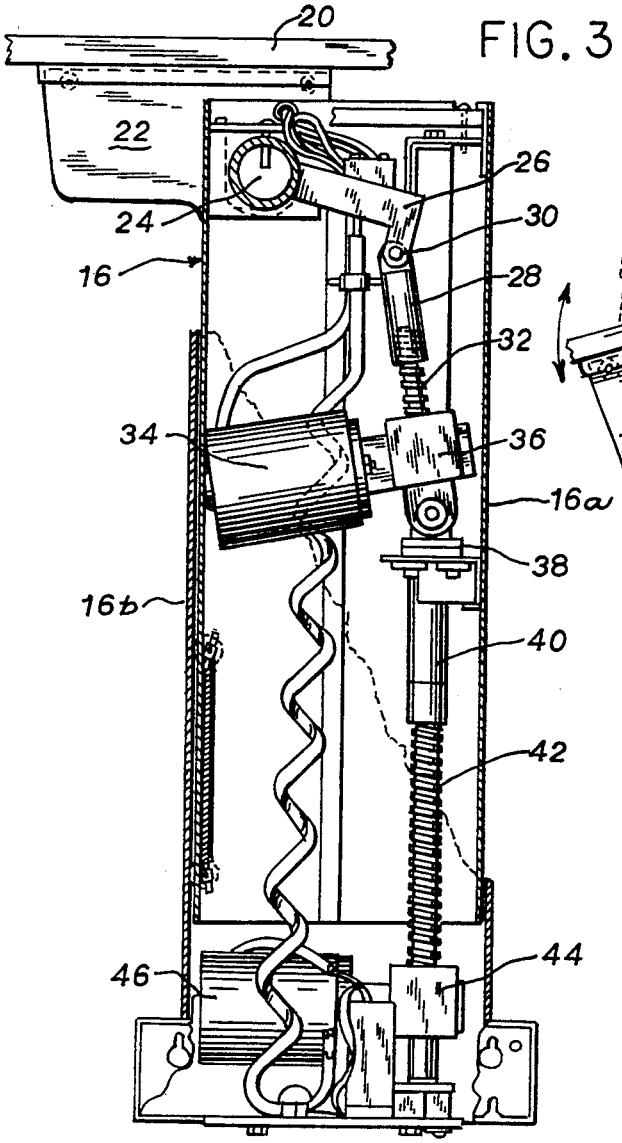
FIG. 3 is a fragmentary, sectional view taken along line 3—3 of FIG. 1, with the table top shown in a first position, with portions thereof broken away.

Table top 20, which is shown in FIG. 3 in fragmentary manner, is carried on a pivot mounting 22, which, in turn, is mounted on pivot 24 carried on column 16. Pivot arm 26 is attached to pivot mounting 22 and communicates with threaded sleeve 28 through a second pivot 30. Rotatable worm gear 32 is provided, being operable by motor 34 so that as worm gear 32 rotates, sleeve 28 moves inwardly or outwardly along the worm gear to cause pivot arm 26 to rotate. This, in turn, results in the pivoting of pivot mount 22 and table top 20. Motor 34 is capable of operating in either direction to correspondingly cause pivoting of table top 20 in either direction.

Figure 4:
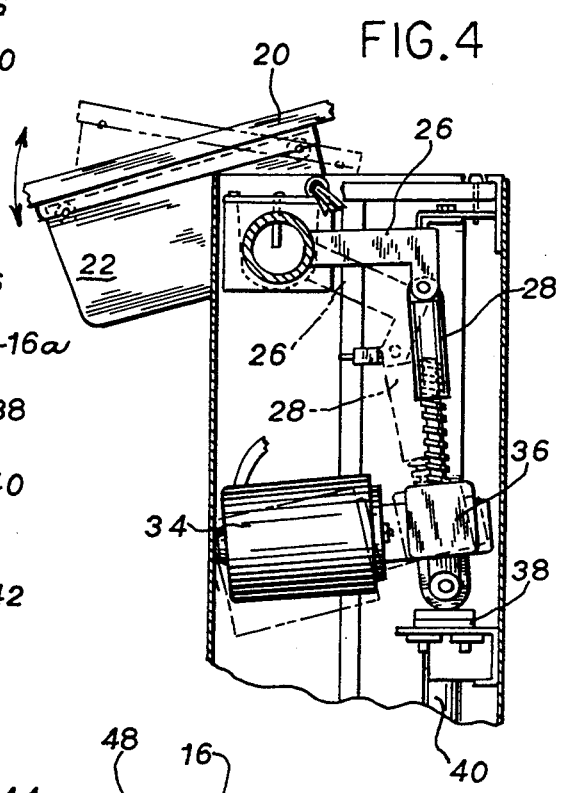
FIG. 4 is a fragmentary, sectional view similar to FIG. 3 showing the table top in other pivoting positions.
Figure 6:
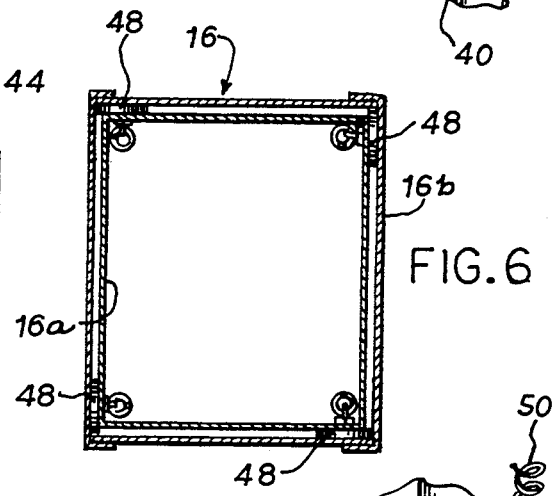
FIG. 6 is a sectional view of the vertical column taken along line 6—6 of FIG. 5.
Figure 5:
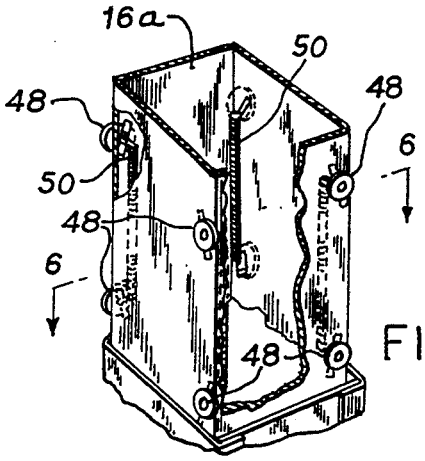
FIG. 5 is a broken away, perspective view of an inner portion of the movably extensible vertical column of the table shown.

FIG. 4 shows another position of the assembly described above as governed by operation of motor 34, with a further pivoting position being shown in phantom lines.

Motor 34 and its transmission 36 are carried on a platform 38 which carries a threaded sleeve 40 which receives a second worm gear 42. This worm gear is carried in a second transmission 44 which is operated by a second electric motor 46. Second electric motor 46 and transmission 44 are then bolted to the bottom of column 16.

Thus, when motor 46 through transmission 44 rotates worm gear 42 in either direction, sleeve 40 is either raised or lowered. Platform 38 is connected to a tubular, inner, vertical column portion 16*a*, which fits in telescoping relation within outer vertical column portion 16*b*, so that, with the raising and lowering of platform 38 driven by motor 46, vertical column portion 16*a* is raised and lowered as well, along with table top 20 and the associated parts.

It should be noted that in FIG. 3 a portion of outer column 16*b* is shown in broken away configuration. In actuality, column 16*b* is in the form of a square tube as shown in FIG. 1.

Figure 7:
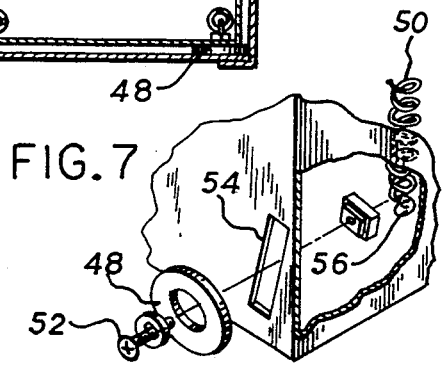
FIG. 7 is a fragmentary, perspective view of a portion of the vertical column shown in FIG. 5.

Inner tubular column portion 16*a* carries optional spring-tensioned stabilizer wheels 48 which serve to facilitate the telescoping, sliding movement between inner column portion 16*a* and outer column portion 16*b*, in accordance with the disclosures of Kritske U.S. Pat. No. 4,381,095, the disclosures of which are incorporated herein by reference. As shown in FIG. 7, each roller 48 may be secured to tension spring 50 by means of bolt 52 and appropriate nuts and washers, with bolt 52 being positioned to be slidable in angled slot 54. The end of spring 50 may be welded onto the end of end of bolt 52, or may be retained within looped end 56 of the spring 50 at each end thereof.

Accordingly, a raisable and lowerable table is provided, preferably with two independently movable table tops, which exhibits great versatility of use coupled with low cost of manufacture.

The above has been offered for illustrative purposes only, and is not intended to limit the scope of the invention of this application, which is as defined in the claims below.

That which is claimed is:

1. A raisable and lowerable table which comprises a base, a pair of extensible enclosed vertical columns attached to said base, each vertical column including means for supporting a table top for independent raising and lowering of each table top, and each supporting means including pivoting means for tilting each of said table tops on a horizontal axis through a range of pivoted positions from a horizontal position of said table top, each supporting means including a first independent motor-driven lead screw actuator for raising and lowering each of said vertical columns and a second independent motor-driven lead screw actuator for tilting said table top in any of said range of pivoted positions, said first and second actuators for each column being fully enclosed therein.

2. The table of claim 1 wherein one of said table tops is tiltable through a range of positions in both directions from the horizontal position.

3. The table of claim 1 wherein said first and second actuators for each column are mounted vertically spaced within the column.

4. The table of claim 1 wherein each vertical column comprises telescoping inner and outer column portions, the inner column portion fitting within the outer column portion, and each of said column portions carrying one of said first and second actuators.

5. A work station having a pair of independently adjustable work surfaces, each of which is supported by a separate vertically telescoping column including a movable upper tubular column member and a fixed lower tubular column member and with the columns supported on a common base, the improvement comprising:

adjustable mounting means for attaching each work surface to the upper end of the upper column member;

first linear actuator means secured within each lower column member, extending upwardly through the upper column member and into operative engagement with said mounting means, for moving the attached work surface vertically; and, second linear actuator means secured within each upper column member, extending upwardly into operative engagement with said mounting means for pivoting the attached work surface about a horizontal axis parallel to the surface.

6. The work station as set forth in claim 5 wherein each of said first and second linear actuator means comprises:

an electric motor-driven lead screw attached to the column; and, a tubular nut having a lower end threaded onto the upper end of the lead screw and an upper end attached to said mounting means and secured against axial rotation.

* * * * *